United States Patent [19]

Siemens et al.

[11] 3,985,556

[45] Oct. 12, 1976

[54] REDUCTION OF LATERITE ORES

[75] Inventors: Richard E. Siemens; Philip C. Good, both of Albany, Oreg.

[73] Assignee: The United States of America as represented by the Secretary of the Interior, Washington, D.C.

[22] Filed: Mar. 22, 1976

[21] Appl. No.: 669,360

[52] U.S. Cl. ..... 75/119; 75/82; 75/103

[51] Int. Cl.[2] ..... C22B 23/04

[58] Field of Search ..... 75/21, 82, 103, 119

[56] References Cited

UNITED STATES PATENTS 3,929,468 12/1975 Siemens et al. ..... 75/82

*Primary Examiner*—M. J. Andrews

*Attorney, Agent, or Firm*—Donald R. Fraser; Roland H. Shubert

[57] ABSTRACT

Lateritic nickel ores which also contain magnesia are subjected to a low temperature reduction using carbon monoxide as the sole reductant and are then subjected to a higher temperature heat treatment in an inert atmosphere for a time sufficient to stabilize the nickel in a readily extractable state. The reduction is accomplished at a temperature in the range of 300 to 450°C and the heat treatment is carried out at a temperature above about 650°C.

6 Claims, 1 Drawing Figure

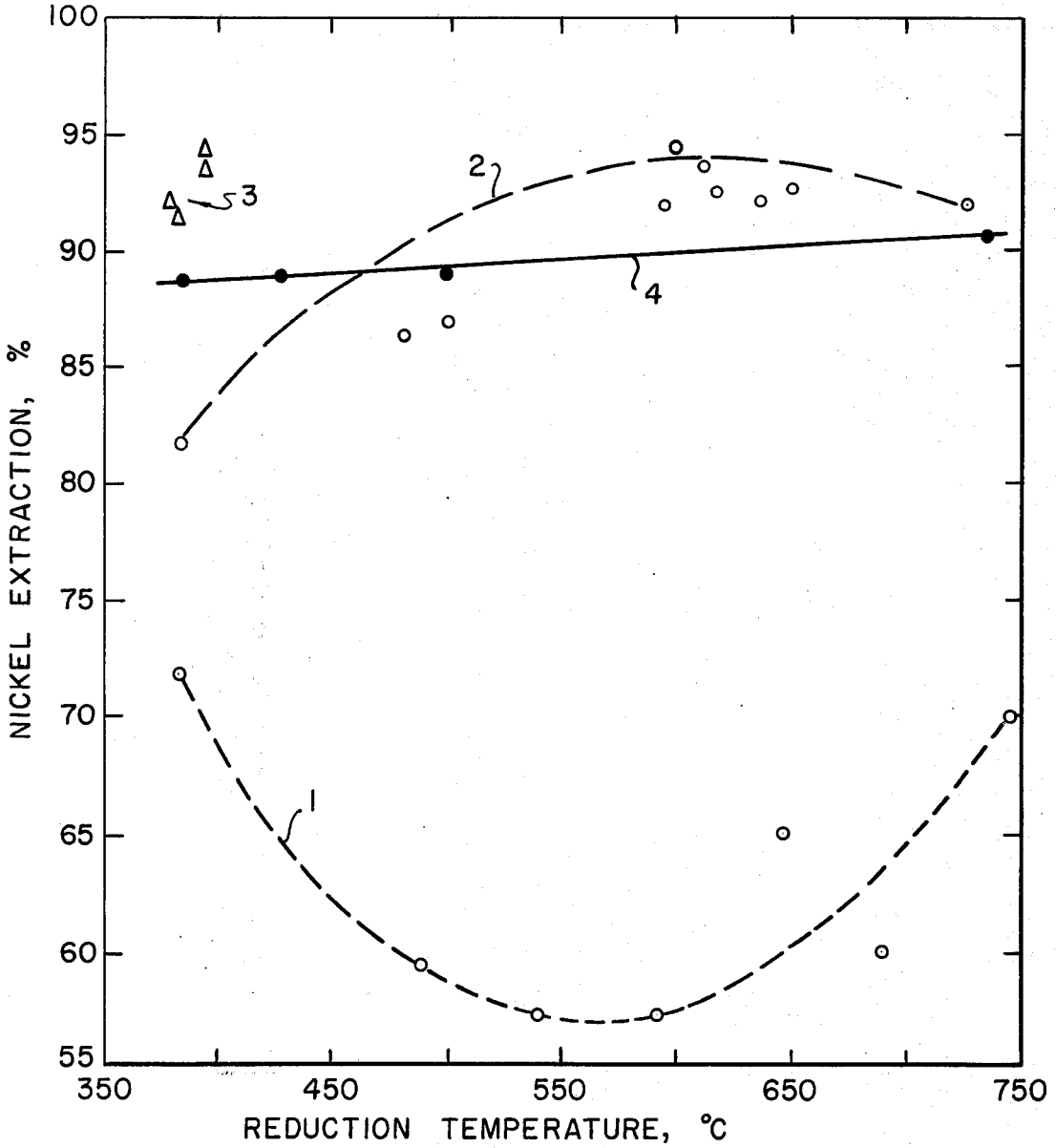
100
95
90
85
80
75
70
65
60
55
NICKEL EXTRACTION, %
350
450
550
650
750
REDUCTION TEMPERATURE, °C
1
2
3
4

REDUCTION OF LATERITE ORES

BACKGROUND OF THE INVENTION

Lateritic ores of nickel contain nickel intimately dispersed throughout the ore in the oxide form. Since it is difficult and often impossible to beneficiate such ores by the usual mineral dressing techniques, it is usual practice to subject the entire ore mass to pyrometallurgical or hydrometallurgical processes or combinations of the two.

There are a number of closely related processes employing a combination of pyrometallurgical and hydrometallurgical techniques. These processes have in common the general steps of reducing nickel, and cobalt if present, contained in the ore to the metallic state followed by an oxidative ammonia, or ammonium salt leach. The reduction step is carried out in the solid state using a variety of gaseous, liquid and solid reductants including hydrogen, carbon monoxide, liquid hydrocarbons and coal or coke. In all instances, efforts are made to perform a selective reduction with the object of attaining as complete as possible reduction of nickel to the metallic state while limiting the amount of iron so reduced.

In our past work, represented by U.S. Pat. No. 3,929,468, we found that laterite ores of nickel could be selectively reduced at temperatures in the range of 350° to 600° C using carbon monoxide as the sole reductant to yield nickel in a highly active elemental form. We also found that relatively high concentrations of magnesia in the ore, higher than about 6 to 7%, caused a substantial decrease in the amount of nickel which could subsequently be extracted in an oxidizing ammonium hydroxide-ammonium sulfate leach. Presumably, reduced nickel undergoes a secondary reaction with magnesia and silicon that renders it inert in the subsequent leach. This secondary reaction is inhibited by providing a source of sulfur, such as pyrite, during the reduction. In addition to the previously cited patent, we have published partial results of our research in the Bureau of Mines Report of Investigations 8027 entitled "Recovery of Nickel and Cobalt from Low-Grade Domestic Laterites", April, 1975.

SUMMARY OF THE INVENTION

We have discovered that nickel extraction from a relatively high magnesia lateritic ore can be significantly increased by first reducing the ore with carbon monoxide at relatively low temperatures and then subjecting the ore to a heat treatment under an inert atmosphere at a temperature above the reduction temperature.

BRIEF DESCRIPTION OF THE DRAWING

THe lone FIGURE is a graphical summary of comparative data obtained by experimentation.

DETAILED DESCRIPTION OF THE INVENTION

We have now found that the interference of magnesium oxide with nickel extraction may be overcome by reducing laterite ores at relatively low temperatures with carbon monoxide and thereafter subjecting the reduced ore to a heat treatment at higher temperatures under an inert atmosphere. In carrying out the process laterite ores of nickel are preferably first pelletized, using water as a binder, and thereafter dried. Drying must be accomplished at temperatures sufficiently high to drive off all free and limonitic water. Limonitic water is defined as that water associated with iron oxides in an adsorbed or hydrate form, or both, which is removable by heating to a temperature on the order of 350° C to 400° C. Water vapor, if present in the reduction stage, decreases the selectivity of the reduction and prevents direct regeneration of the reducing gas stream. Pelletization is for the purpose of controlling dusting during the drying and reduction steps.

Reduction is accomplished at temperatures as low as about 300° C but preferably in the range of 350° to 450° C using carbon monoxide as the sole reductant. Other gaseous reductants, such as producer gas, give substantially poorer results. The reduction step is preferably carried out in a multiple hearth furnace in order to avoid breakage and dusting of the relatively fragile pellets. Reduction time ranges from about 10 minutes to 1 hour depending upon temperature and reducible metal content. After reduction is complete the ore is transferred to a heat treating means which may conveniently comprise a second multiple hearth furnace. There the reduced ore is heated to a temperature substantially above the reduction temperature, or above about 650° C, in an inert atmosphere. Treatment temperatures are preferably in the range of 650° to 750° C. Treatment times required are relatively brief; on the order of 10 minutes to an hour. The inert atmosphere may conveniently comprise argon or nitrogen but other inert gases such as helium may be used.

After heat treatment is complete, the ore must be cooled below about 200° C before it is exposed to an aqueous leach medium. The reduced ore is highly active. It is pyrophoric and will actually flame if exposed to oxygen and will react with water to produce hydrogen gas at temperatures above about 200° C. Cooling, of course, must be accomplished under an inert atmosphere.

The nickel, and cobalt if present, may be leached from the reduced ore using a variety of leaching agents including chlorine, ammonium hydroxide-ammonium carbonate solutions and ammonium hydroxide-ammonium sulfate solutions. We prefer to accomplish the leaching and recovery of nickel and cobalt using ammonium hydroxide-ammonium sulfate leach solutions as described in our U.S. Pat. No. 3,929,468.

Experimental work has shown that our post heating technique is applicable to laterite ores generally which contain sufficient magnesia to interfere with subsequent nickel extraction. In those lateritic ores containing but a small amount of magnesia, the heat treatment appears to have no discernable effect on nickel recovery. Other types of ores, such as deep sea manganese nodules, do not respond to the treatment.

The following examples more fully set out specific embodiments of our invention.

EXAMPLE 1

A sample of laterite ore was obtained from the Pine Flat deposit located in northern California and southern Oregon. Chemical analysis gave the following composition in weight %: Ni, 0.97; Co, 0.2; Fe, 36.1; Mn, 0.5; Cr, 1.87; MgO, 7.22; $SiO_2$, 21.5; $Al_2O_3$, 4.11; and CaO, 0.08. The ore was pelletized using water as a binder and was thereafter dried to remove all free moisture and limonitic water.

A series of batch reduction tests were then performed on the pellets. Reduction was carried out in a vertical tube furnace using carbon monoxide of minimum 99% purity as the sole reductant. After completion of the reduction, each charge was cooled in an inert atmosphere and the reduced metals were extracted by aqueous chlorination using chlorine gas sparged through an agitated slurry having a solids content of about 20% at a temperature of 80° to 90° C. The chlorination reaction was determined to be complete when the pH reached 1.8 to 2.0.

Results of these tests are presented graphically in the FIGURE. Curve 1 is a plot of nickel extraction versus temperature for a series of test reductions of the pelletized laterite. Curve 2 is a similar plot but represented test reductions identical to those of Curve 1 except for the addition of 1.2 weight % pyrite to the laterite charge. The effectiveness of pyrite in increasing nickel extraction is clearly evident.

Points 3 represent results obtained by subjecting the reduced ore charges to a post heat in argon at 705° C for approximately 30 minutes. Curve 4 represents a series of identical tests run on a different laterite ore of similar analysis but containing about 2% less magnesia. These results show the effectiveness of the post heat treatment of reduced high magnesia laterites as compared to pyrite additions.

EXAMPLE 2

Another sample of Pine Flat laterite was found to have the following analysis in weight %: Ni, 0.87; Co, 0.21; Fe, 35.7; $SiO_2$, 18.7; $Al_2O_3$, 4.0; Mn, 0.44; Cr, 2.19; and MgO, 7.1. The ore was pelletized and dried as before. One portion of the ore was reduced with carbon monoxide at 350° C and was then subjected to a post heat treatment in argon at 700° C for 30 minutes. The charge was then cooled in an inert atmosphere and leached using an oxidizing ammonium hydoxide-ammonium sulfate solvent system. Nickel extraction was 89.4%.

Another sample of the same pelletized ore was treated identically except that producer gas rather than carbon monoxide was used as the reductant. Nickel extraction was 59%. The effectiveness of the post heat treatment appears limited to ores reduced with carbon monoxide.

EXAMPLE 3

Pacific Ocean manganese nodules containing 1.43% Ni, 0.2% Co, and 1.1% Cu were dried and reduced with carbon monoxide at 380° C. One charge was subjected to a post heat treatment in argon at 700° C for 30 minutes while a second charge was not. Both charges were then leached in an oxidizing ammonium hydroxide-ammonium sulfate solution. There was obtained an extraction of 84% of the Ni, 60% of the Co and 92.2% of the Cu from the post heated charge. On the other hand, there was obtained an extraction of 90.2% of the Ni, 76.1% of the Co and 94.3% of the Cu from the charge not subjected to the post heat treatment. It was concluded that the post heat treatment is not effective with ores of this type.

We claim:

1. A process for the selective reduction of nickel and magnesia-containing laterite ores which comprises:

contacting said ore with a reducing gas consisting essentially of carbon monoxide at a temperature in the range of 300° to 450° C for a time sufficient to reduce substantially all of the nickel contained in the ore to the elemental state, said contacting being performed in the absence of water vapor;

removing said ore from contact with the reducing gas before substantial reduction of iron oxides to metallic iron occurs;

heating the reduced ore in an inert atmosphere at a temperature above about 650° C for a time sufficient to stabilize the elemental nickel in an extractable form, and cooling the reduced ore to a temperature below about 200° C in an inert atmosphere prior to performing any subsequent processing steps.

2. The process of claim 1 wherein the magnesia content of said laterite ore is greater than 6%.

3. The process of claim 2 wherein said reduced ore is heated in an inert atmosphere at a temperature in the range of 650° to 750° C.

4. The process of claim 3 wherein said inert atmosphere is selected from the group consisting of argon, nitrogen and mixtures thereof.

5. The process of claim 4 wherein the reduced ore is maintained at a temperature within the range of 650° to 750° C for a time ranging from 10 minutes to 1 hour.

6. The process of claim 1 wherein the nickel content of the cooled, reduced ore is extracted by an oxidizing ammonium hydroxide-ammonium sulfate leach.

* * * * *